US007841700B2

(12) United States Patent
Cannon et al.

(10) Patent No.: US 7,841,700 B2
(45) Date of Patent: Nov. 30, 2010

(54) RADIATION ACTIVATED MICRO-FLUID EJECTION DEVICES AND METHODS FOR EJECTING FLUIDS

(75) Inventors: Roger Steven Cannon, Nicholasville, KY (US); Robert Lee Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1043 days.

(21) Appl. No.: 11/561,692

(22) Filed: Nov. 20, 2006

(65) Prior Publication Data

US 2008/0117255 A1 May 22, 2008

(51) Int. Cl.
*B41J 2/165* (2006.01)

(52) U.S. Cl. ..... 347/51

(58) Field of Classification Search ..... 347/51–52
See application file for complete search history.

(56) References Cited

U.S. PATENT DOCUMENTS 5,021,808 A 6/1991 Kohyama
6,854,829 B2 2/2005 Te
6,857,368 B2 2/2005 Pitz
2004/0201646 A1 10/2004 Sohn et al.
2006/0187260 A1 * 8/2006 Yaron ..... 347/51

* cited by examiner

*Primary Examiner*—Lamson D Nguyen

(57) ABSTRACT

Micro-fluid ejection devices, such as inkjet printheads, such as those that use a laser to eject fluid. One such micro-fluid ejection device includes a passageway plate defining a fluid chamber filled with fluid and a fluid channel to supply the fluid chamber with fluid, a top plate provided on the passageway plate, a fluid ejection hole formed through the top plate at a position corresponding to the fluid chamber, a condenser lens provided on a bottom surface of the passageway plate at a position corresponding to the fluid chamber, and laser beam irradiator capable of irradiating a laser beam through the condenser lens and into fluid contained in the fluid chamber, wherein the fluid is nucleated by the laser beam such that a vapor bubble forms and displaces a portion of the fluid, thereby ejecting a fluid droplet through the fluid ejection hole. Method of using such devices are also disclosed.

16 Claims, 3 Drawing Sheets

RADIATION ACTIVATED MICRO-FLUID EJECTION DEVICES AND METHODS FOR EJECTING FLUIDS

BACKGROUND OF THE INVENTION

1. Field of the Invention

The present invention relates generally to micro-fluid ejection devices and fluid ejecting methods; and specifically, in an exemplary embodiment, to an inkjet printhead and an ink ejecting method using a laser to nucleate ink contained within a printhead so as to rapidly grow a vapor bubble which displaces a portion of the ink, thereby ejecting an ink droplet.

2. Background of the Invention

Typically, ink-jet printheads are used for printing a predetermined image by ejecting a small volume droplet of printing ink at a desired position on a recording media or substrate. In such inkjet printheads, ink ejection mechanisms are largely categorized into two types depending on which ink droplet ejection method is used. One type of conventional inkjet printhead is a thermally driven inkjet printhead in which a thin-film, heater stack based heat source is employed to form bubbles in ink to cause ink droplets to be ejected by an expansion force of the bubbles. This type of inkjet printhead has proven to be inefficient as large amounts of energy are required to boil the ink and form the bubbles. In addition, there is a limitation on the type of ink used.

In addition, other ink droplet ejection methods have been developed and are conventionally used in inkjet printheads. In one such conventional method, a piezoelectric crystal having a concave surface and a convex surface is installed under a surface of ink to be ejected. An electrode is provided on the concave surface of the piezoelectric crystal and three other electrodes are provided on the convex surface of the piezoelectric crystal. The piezoelectric crystal produces sonic energy, and an acoustic pressure generated by the sonic energy vibrates the surface of the ink. If the acoustic pressure exceeds the surface tension of the ink and atmospheric pressure, ink droplets are ejected from the surface of the ink through a hole in a passageway plate of the printhead. Selective combinations of electrodes are operable for controlling an ejecting direction of each of the droplets. Disadvantageously, the above described ejecting method presents a problem due to a complex structure thereof because the hemispherical piezoelectric crystal and the electrodes must be installed under the surface of the ink.

In another conventional printhead device, an ink droplet ejecting method using a laser is disclosed. Typically, a printhead is provided which includes a plurality of chambers containing multiple colored inks, a semiconductor laser for selectively irradiating a laser beam onto the inks, and a condenser lens which converges the laser beam. The laser beam emitted from the semiconductor laser is selectively irradiated through the condenser lens onto the inks contained in the chambers. Accordingly, the inks evaporate and the evaporating inks move to a substrate. This ink ejecting method, however, is disadvantageous in that control of the procedure is complex and a large amount of energy is consumed.

In still another conventional ink ejecting method, an ink ejecting method in which a buffered solution is boiled using a laser and the ink is ejected by vibrations caused by the boiling of the buffered solution is taught. This method has similar problems with the foregoing prior art in that the structure of the ink-jet printhead is complex and a large amount of energy is consumed.

In still another type of conventional ink ejecting method, a printhead is disclosed which causes the ink to vibrate through the use of a laser having a sufficiently high energy to generate a pressure wave which expels the ink. While this method avoids the need for boiling the ink, it requires an excessive heating cycle to elicit the density response necessary for expulsion.

SUMMARY OF THE INVENTION

In view of the shortcomings of the current printheads and methods of ejecting ink therefrom, a need exists for an improved printhead and method for ejecting ink.

According to an exemplary embodiment, a micro-fluid ejection device is provided that includes a fluid chamber operable for containing a fluid, such as ink, a fluid ejection hole corresponding to the fluid chamber, a lens provided adjacent to the fluid chamber, and an irradiator. The irradiator provides radiation through the lens and into fluid contained in the fluid chamber, the fluid is nucleated by the radiation such that a vapor bubble is formed and displaces the fluid, and droplet of fluid is ejected through the election hole.

In exemplary embodiments, the fluid chamber may be defined in a silicon substrate that is transparent with respect to an infrared ray or a glass substrate, for example. In some exemplary embodiments, the irradiator may be an infrared laser, while in other exemplary embodiments, the irradiator may be a diode laser, for example. In certain exemplary embodiments, the lens may be integrally formed with a passageway plate. Alternatively, for example, a lens plate might be provided on a bottom surface of the passageway plate, the lens plate including at least one lens, such as a lens having a convex shape or a diffractive lens.

The chamber may, in some embodiments, be a plurality of chambers positioned at intervals along a passageway plate. Similarly, the ejection hole may, in some embodiments, be a plurality of ejection holes, each formed at a location corresponding to one of the plurality of chambers. Still further, in some embodiments, the lens may be a plurality of condenser lenses, each formed at a location corresponding to one of the plurality of chambers, and/or the irradiator may comprise a plurality of radiation sources, such as lasers, each located at a position corresponding to one of the plurality of chambers. In some exemplary embodiments, the chamber may also be coated with a coating, such as for adding resistive properties to cavitation caused by repeated nucleation events which eject the fluid from the chamber. In still further exemplary embodiments, the fluid utilized will include an aborbing agent tuned to a wavelength of the radiation, such as to nucleate the least light absorptive species of fluid. Such a system may be provided by incorporating, for example, an infrared absorbing agent into the fluid as a component of the fluid or as either an additive or admixture.

According to another exemplary embodiment of the present invention, a method of ejecting fluid is provided that includes irradiating a fluid in a fluid chamber of a micro-fluid ejection device using radiation, wherein the ink is nucleated and a vapor bubble is formed in the fluid that causes a fluid droplet to be ejected from the device. In an exemplary form of the method, a plurality of ink chambers, lenses and lasers may be provided, each being located at corresponding positions, the lasers being operable for irradiating a laser beam into an ink chamber filled with ink such that the ink is nucleated and a droplet is ejected from the device, which may be a printhead. In exemplary embodiments, the plurality of lasers may be operated independently such that a single laser may irradiate and nucleate a single ink chamber to expel a single ink droplet at a desired time interval. Alternatively, for example, multiple lasers may be operated at the same time to irradiate and nucleate multiple ink chambers, thereby ejecting multiple ink droplets at the same time.

Additional features and advantages of the invention are set forth in the detailed description which follows and will be readily apparent to those skilled in the art from that description, or will be readily recognized by practicing the invention as described in the detailed description, including the claims, and the appended drawings. It is also to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof. Additionally, the drawings and descriptions are meant to be merely illustrative and not limiting the intended scope of the claims in any manner.

DETAILED DESCRIPTION OF EXEMPLARY EMBODIMENTS

Figure 1:
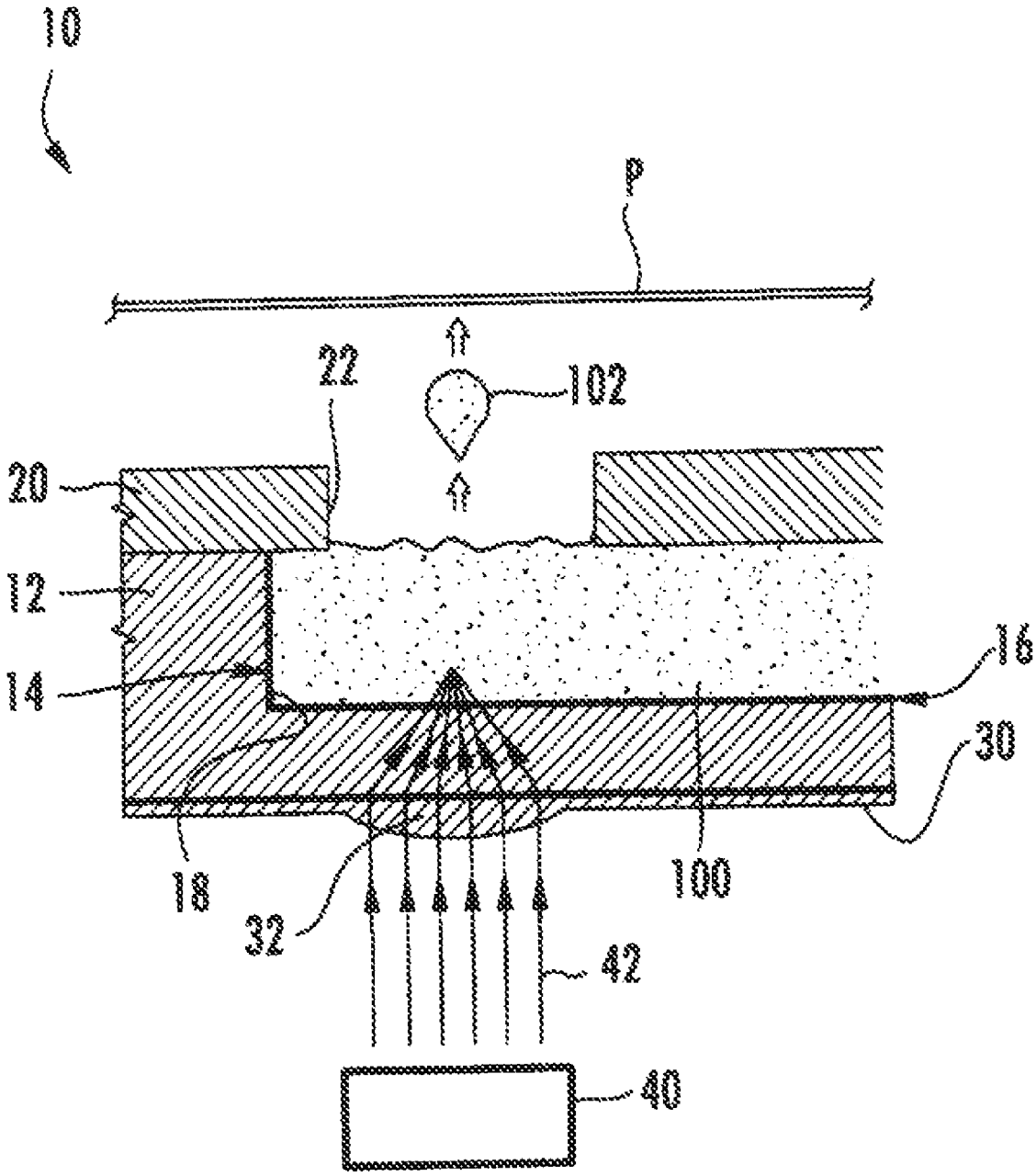
FIG. 1 is a schematic diagram of a partial cross-sectional view of a unit structure of an inkjet printhead according to an exemplary embodiment of the present invention.

Reference will now be made in detail to exemplary embodiments of the invention, which are illustrated in the accompanying drawings. Whenever possible, the same reference numerals will be used throughout the drawings to refer to the same or like parts. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The present invention, in one embodiment, provides an inkjet printhead operable for nucleating and ejecting a droplet of ink upon a substrate, such that the droplets deposited form desired image/pattern. In one such embodiment, the printhead includes a passageway plate defining at least one ink chamber, at least one ink channel, and at least one ejection hole through which ink droplets may pass. Such an exemplary printhead further includes at least one laser operable for emitting a laser beam through a lens located on the passageway plate and into the ink chamber such that the ink is nucleated. In exemplary embodiments described herein, the ink is ejected from the printhead because it is displaced by a vapor bubble caused by a nucleation event. By using such a printhead and method, manufacture of the inkjet device is not limited to the use of traditional round silicon manufacturing processes. Still further, by using such a printhead and method, a more energetic ejection method is provided over conventional and known methods. Still further, by using such a printhead and method, a heat cycle used to cause the ejection of the ink can be reduced to, for example, 500-1000 nanoseconds. The use of the exemplary printhead and methods may also permit for a higher frequency jetting response.

Referring now to FIG. 1, a partial cross-sectional view of a unit structure of an exemplary micro-fluid ejection device, here embodied as inkjet printhead 10, according to an exemplary embodiment of the present invention is illustrated. As shown in FIG. 1, a passageway plate 12 may include a fluid chamber 14 filled with a fluid such as ink 100 to be ejected and a fluid channel 16 for supplying the chamber 14 with the ink 100. A fluid ejection hole 22 is formed through a top plate 20, which is attached on a top surface of the passageway plate 12, at a position corresponding to the fluid chamber 14.

The ink 100 contained in the chamber 14 is ejected in the form of a droplet 102 through the ejection hole 22. In an exemplary embodiment, a lens plate 30 is provided on a bottom surface of the passageway plate 12. A condenser lens 32 is provided at a position of the lens plate 30 corresponding to the chamber 14. In other alternative embodiments, the lens 32 may be integrally formed with the bottom surface of the passageway plate 12. It will be understood by those skilled in the art that by using an integral lens 32 with the passageway plate 12, the overall structure and manufacturing process may be simplified.

An irradiator such as, e.g., a diode laser 40, is capable of irradiating radiation (e.g., a laser beam 42) through the lens 32 and into the ink 100 contained in the chamber 14, and may be provided under the lens plate 30. In exemplary embodiments, the laser beam 42 is provided with a diameter no larger than 150% of the size of the condenser lens 32. It will be understood by those skilled in the art that laser energy not being focused upon the ink 100 by the condenser lens 32 is not substantially contributive to the energy required for nucleation.

The chamber 14 is filled with the ink 100 supplied from a reservoir (not shown) through the channel 16. It is to be understood that the ink 100 may be supplied to the chamber 14 by a capillary force.

In exemplary embodiments, the passageway plate 12 surrounding the chamber 14 and the channel 16 is substantially transmissive to the wavelength of light used by the irradiator (e.g., laser 40) so as to cause the heating and nucleation event. By way of example, the passageway plate 12 may be formed of a transparent material through which a laser beam 42 is transmitted, e.g., a silicon substrate that is transparent with respect to infrared rays. Alternately, the passageway plate 12 may be formed of a glass substrate, which is transparent with respect to visible light and ultraviolet rays as well as infrared rays. If the passageway plate 12 is formed of a silicon substrate, an infrared ray may be used as the laser beam 42. If the passageway plate 12 is formed of a glass substrate, there are few limitations on the type of laser beam 42 used. Various examples of passageway plate materials and complimentary lasers (with appropriate wavelength ranges) are set forth in Table 1:

TABLE 1

| Passageway Plate Material | Wavelength Range of Laser |
|---|---|
| Silicon | 1.0-10.0 μm |
| $SiO_2$ | 0.25-3.5 μm |
| UV Grade Fused Silica | 170 nm-4.0 μm |
| IR Grade Fused Silica | 170 nm-4.0 μm |
| $Al_2O_3$ | 0.2-5.0 μm |
| MgO | <1-10.0 μm |

The top plate 20 may also be formed of a silicon substrate, or other various kinds of materials may also be used (e.g., polyimide films, photoresists, or other polymer based options). However, in view of a surface property of the top plate 20, in one exemplary embodiment, the top plate 20 preferably has a hydrophobic surface so that the ink 100 is not easily smeared. As described above, the top plate 20 has the ejection hole 22, which does not function as a nozzle but functions as a path through which an ink droplet 102 is ejected from a free surface of the ink 100 contained in the chamber 14. In an exemplary embodiment, the ink ejection hole 22 is sufficiently large to prevent contact between the ink droplet 102 being ejected and the top plate 20. The ink ejection hole 22 can be circular in shape, but it may have various other shapes, including an oval or polygonal shape.

As described above, the lens plate 30 has the condenser lens 32 at a position corresponding to the chamber 14. The condenser lens 32 may be shaped as a convex lens, as shown in FIG. 1, and converges the laser beam 42 emitted from the diode laser 40 to be focused on a predetermined portion of the ink 100 contained in the chamber 14. In a state in which the condenser lens 32 is formed, the lens plate 30 may be attached to the bottom surface of the passageway plate 12. The condenser lens 32 may be formed by microprocessing a resultant structure formed after the lens plate 30 is disposed on the bottom surface of the passageway plate 12.

Figure 3:
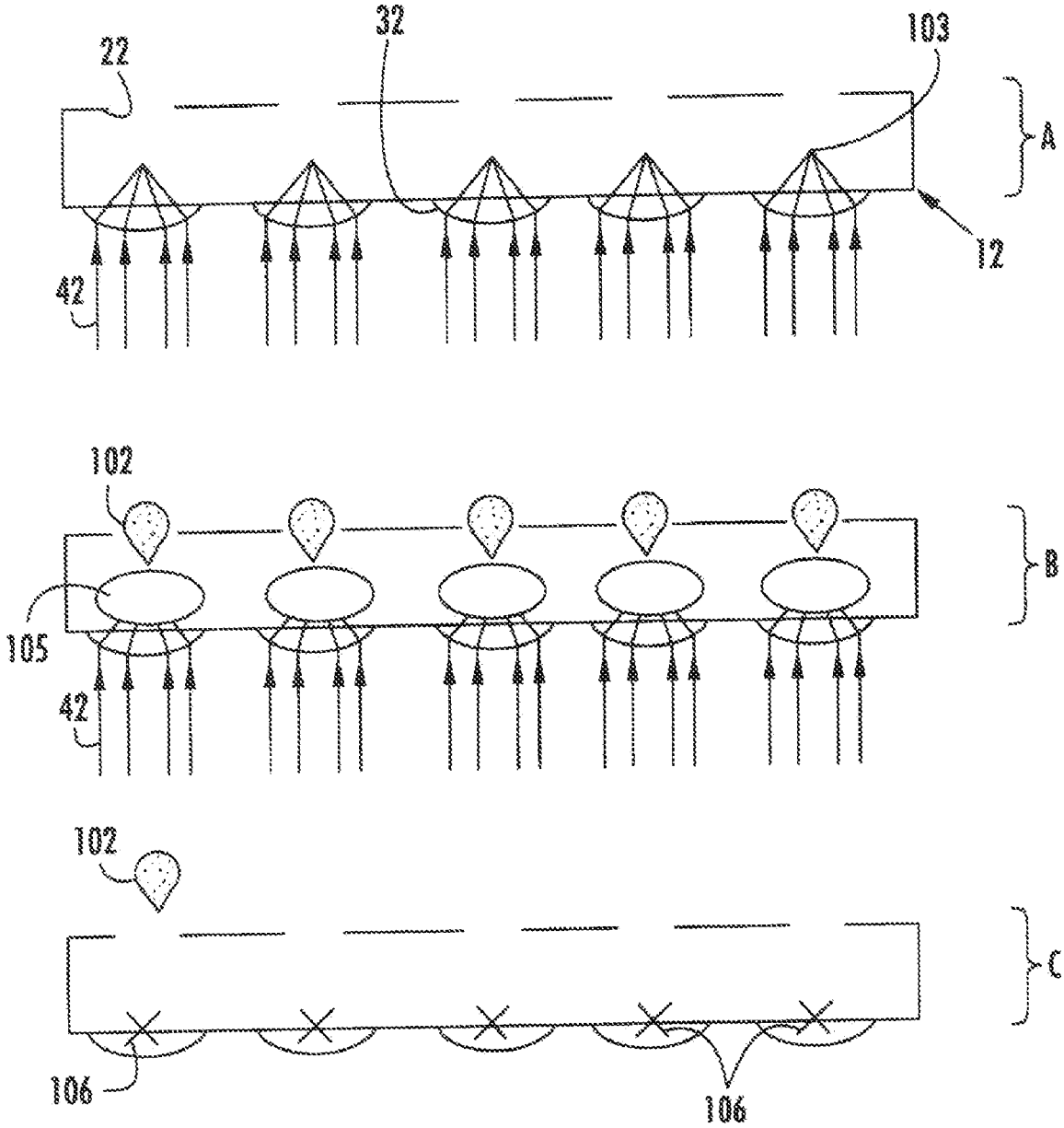
FIG. 3 illustrates a detailed implementation example of the nucleation event of the method disclosed using an inkjet printhead having a plurality of ink chambers, ink ejection holes, and lasers.

The method of ejecting an ink droplet from the inkjet printhead according to the exemplary embodiment of the present invention will now be described with reference to FIGS. 1 and 3. First, ink 100 fills the chamber 14. The ink 100 may be supplied into the chamber 14 through the channel, 16 by a capillary force. Subsequently, as shown in Step A, the laser beam 42 emitted from the diode laser 40 is converged by the condenser lens 32 to a focal point 103 and irradiated into a predetermined portion of ink 100 within the chamber 14. As described above, when the laser beam 42 is irradiated into the ink 100, the energy of the laser beam 42 is absorbed by the ink 100. Particularly, as shown in Step B, if a laser beam having high energy is irradiated into the ink 100 for a relatively short time (e.g., about 500-1000 nanoseconds), the ink is nucleated and a vapor bubble 105 rapidly grows which displaces a portion of the ink and expels an ink droplet 102 from the ink 100. The separated ink droplet 102 is ejected through the ejection hole 22 toward a substrate P provided in front of the ink droplet 102. As the ink droplet 102 is ejected, ink 100 refills the chamber 14 through the channel 16. Further, as shown in Step C, the vapor bubble 105 collapses back onto the passageway plate 12 at a cavitation point 106.

In exemplary embodiments, the passageway plate 12 is provided with a coating 18, such as, but not limited to, tantalum. The coating 18 may be located along the ink side surface of the passageway plate 12 and provides mechanically strong properties and is transparent to the laser beam wavelength used. Thus, when the nucleated vapor bubble 105 collapses back onto the passageway plate 12, the mechanical structure of the plate 12 should be better preserved and better resist cavitation. It will be understood by those skilled in the art that cavitation may be caused by the vapor bubble 105 that is formed during the nucleation event collapsing back into the point space or cavitation point 106. Understanding that the forces created by repeated cavitation events may affect the structural integrity of the material of the passageway plate 12, the present inventors determined that it may be desirable to reinforce the passageway plate 12.

As described above, in the ink ejecting method described herein, the ink droplet 102 is ejected only by having the ink 100 nucleated by the laser 40 to the point of having the vapor bubble 105 rapidly grow and displace a portion of the ink 100. Thus, a relatively high efficiency of energy can be achieved. In addition, the heat cycle required for conventional printheads and methods is shortened, thereby providing a higher speed of printing.

Further, while any type of fluid formulation may be used in accordance with the present invention, it has been found that using a system which has a formulation in tune with, or corresponding to, the laser beam wavelengths to nucleate the weakest light absorptive species of ink can be preferred. One such manner of providing a tuned fluid and laser system is by the inclusion of an infrared absorbing agent in the fluid, such as one that provides for more reliable and predictable nucleation zones and nucleation physics. The infrared absorbing agent may be a component of the fluid (e.g., ink) formulation or an additive or admixture which is added to the fluid prior to ejection. In exemplary embodiments, the infrared absorbing agent may be 2[2-[2-chloro-3-[2-(3-ethyl-1,3-dihydro-1,1-dimethyl-2H-benzo[e]indol-2-ylidene)-ethylidene]-1cyclohexen-1-yl]-ethenyl]3-ethyl-1,1dimethyl-1H-benzo[e]indolium tetrafluoroborate having the empirical formula $C_{42}H_{44}BClF_4N_2$ and a molecular weight of 699.084 g $mol^{-1}$. The structural formula of the infrared-absorbing agent is as follows:

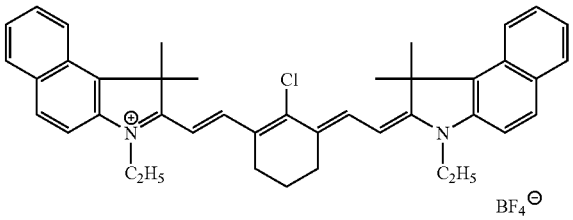

The foregoing infrared-absorbing agent has an absorption maximum at 816 nm and a maximum extinction of 898704 $(mol*cm)^{-1}$. For a laser light absorption of approximately 90%, 0.9 percent by weight of the infrared-absorbing agent is required as an additive in the colors C, M and Y for a layer thickness of 2 μm (according to the Lambert-Beer extinction law). (In comparison: 0.5 percent by weight for approximately 75%, 0.3 percent by weight for approximately 50%, and 0.1 percent by weight for approximately 30%). The device for supplying radiant energy includes, as the radiant energy source, a laser which emits at 808 nm; for example, a HLU 100 c 10×12 diode laser may be used. One such laser may have a maximum optical power output of 100 W. The beam geometry downstream of the collimator is 10 mm×12 mm. Thus, the emission wavelength is sufficiently resonant to the absorption maximum of 816±15 μm; the infrared-absorbing agent shows an absorption greater than 50%. In this exemplary embodiment, a beam profile and an irradiation time of 40 ms for an energy per area of 833 $mJ/cm^2$ have been selected, the printing speed being 0.5 m/s (which corresponds to 3600 prints per hour for a sheet length of 50 cm). The absorption of radiation by water vapor in the air is below 0.5%.

Another manner of providing a fluid and laser system which is in tune is through the use of a multiple laser system. Such a system might use a 4 laser system scanning a single array of 600 dpi ejectors with an ejector fire frequency of 24 kHz. In an exemplary embodiment, the system would utilize 3.3 watt lasers. Further, the number of lasers needed can be proportional to the power output of the laser. For example, 8, 1.65 W lasers diodes could be used to operate a 600 dpi 8.5"

at 24 kHz. It will be understood by those skilled in the art that the disclosed system could be used to produce a nucleation "knee" at 3 GJ/$m^3$. Further, it will be understood by those skilled in the art that the volume of fluid that would take part in an exemplary nucleation event might be approximately 200 $\mu m^3$, for example, although this may be changed based on the intended use of the system (e.g., intended drop volume to be ejected).

Figure 2:
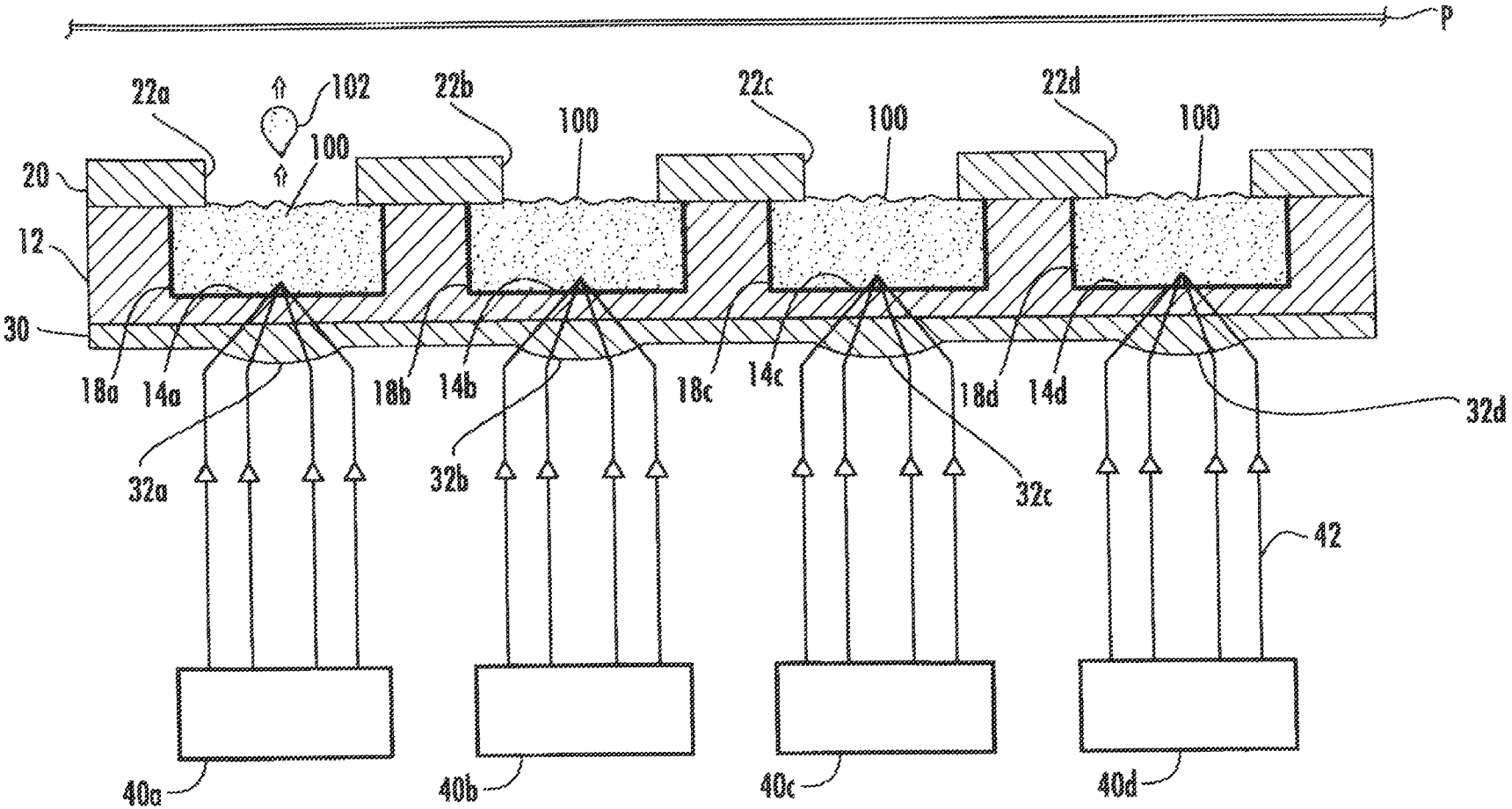
FIG. 2 is a schematic diagram, of an exemplary embodiment of an inkjet printhead having a plurality of ink chambers, lasers and ink ejection holes.

Referring now to FIG. 2, a schematic detail example of an exemplary embodiment of an inkjet printhead having a plurality of ink chambers, lasers and ink ejection holes is illustrated. As shown in FIG. 2, a plurality of ink chambers 14*a*-14*d* are arranged in a passageway plate 12 each at predetermined intervals, and ink 100 fills the respective ink chambers 14*a*-14*d*. Although not shown, an ink channel is connected to each of the plurality of ink chambers 14*a*-14*d*, as in FIG. 1. A plurality of ink ejection holes 22*a*-22*d* are formed in a top plate 20, which is disposed on the passageway plate 12, each at a position corresponding to one of the plurality of ink chambers 14*a*-14*d*. In addition, a plurality of condenser lenses 32*a*-32*d* are provided in a lens plate 30 provided on the bottom surface of the passageway plate 12 to correspond to the plurality of ink chambers 14*a*-14*d*. As described above, in an alternate configuration, the plurality of condenser lenses 32*a*-32*d* may be integrally formed with the passageway plate 12.

When the plurality of ink chambers 14*a*-14*d* are provided in the passageway plate 12 as shown in FIG. 2, a plurality of lasers 40*a*-40*d* are also provided as laser beam irradiators, each of the plurality of lasers 40*a*-40*d* being positioned to correspond to the plurality of ink chambers 14*a*-14*d*. In exemplary embodiments, the plurality of lasers 40*a*-40*d* may be operated independently such that a single laser 40*a* may irradiate and nucleate ink 100 of a single ink chamber 14*a* to eject a single ink droplet 102 at a desired time interval toward a substrate P, as has been described above. Alternatively, multiple lasers may be operated to irradiate and nucleate ink 100 in multiple ink chambers to eject multiple ink droplets 102 at the same time toward a substrate P, as has been described above.

Thus, since ink 100 contained in the plurality of ink chambers 14*a*-14*d* may be ejected by a plurality of lasers 40*a*-40*d*, errors caused by conventional printhead devices having a single laser scanning system for scanning over wide sweeping lengths may be minimized and/or eliminated. Therefore, a high-integration, high-resolution, and efficient inkjet printhead (or other micro-fluid ejection device) can be provided. Further, as described above, according to the exemplary embodiments herein, since ink is ejected by a nucleation event caused by the use of a laser beam, for example, a relatively high efficiency of energy can be achieved. In addition, the heat cycle required for conventional printheads and methods may be shortened, thereby providing a higher speed of printing (or other ejection).

It will be apparent to those skilled in the art that various modifications and variations can be made to the present invention without departing from the spirit and scope of the invention. Thus, it is intended that the present invention cover all conceivable modifications and variations of this invention, provided those alternative embodiments come within the scope of the appended claims and their equivalents.

What is claimed is:

1. A micro-fluid ejection device comprising:

a passageway plate;

a fluid chamber defined in the passageway plate operable for containing a fluid filled through a fluid channel also defined in the passageway plate;

a fluid ejection hole defined through a top plate corresponding to the fluid chamber, the passageway plate having a thickness from a bottom of the fluid channel in the fluid chamber to an underside of the top plate;

a lens provided adjacent to the fluid chamber; and an irradiator, wherein the irradiator provides radiation through the lens and into the fluid contained in the fluid chamber, the fluid is nucleated by the radiation such that a vapor bubble is formed and directly adjacently displaces the fluid as a droplet of fluid ejected through the fluid ejection hole, the thickness of the passageway plate being sufficiently thin to enable the formed bubble to directly eject the droplet through the top plate, the fluid chamber having a coating on a fluid side surface thereof to protect the passageway plate against cavitation effects from collapse of the vapor bubble.

2. The micro-fluid ejection device of claim 1, wherein the fluid chamber is defined in a silicon substrate that is transparent with respect to an infrared ray.

3. The micro-fluid ejection device of claim 2, wherein the irradiator comprises an infrared laser.

4. The micro-fluid ejection device of claim 1, wherein the fluid chamber is defined in a glass substrate.

5. The micro-fluid ejection device of claim 1, wherein the lens is integrally formed with the passageway plate.

6. The micro-fluid ejection device of claim 1 further comprising: a lens plate provided on a bottom surface of a passageway plate, the lens plate including the lens.

7. The micro-fluid ejection device of claim 1, wherein the irradiator is a diode laser.

8. The micro-fluid ejection device of claim 1, wherein the lens comprises a convex shaped lens.

9. The micro-fluid ejection device of claim 1, wherein the lens comprises a diffractive lens.

10. The micro-fluid ejection device of claim 1, wherein the fluid chamber comprises a plurality of fluid chambers positioned at intervals in the passageway plate, the fluid ejection hole comprises a plurality of fluid ejection holes, each formed at a location corresponding to one of the plurality of fluid chambers, the irradiator comprises a plurality of radiation sources, each located at a position corresponding to one of the plurality of fluid chambers, and the lens comprises a plurality of condenser lenses, each formed at a location corresponding to one of the plurality of fluid chambers.

11. The micro-fluid ejection device of claim 1, wherein the fluid ejection hole is formed in a silicon substrate.

12. The micro-fluid ejection device of claim 1, wherein the fluid includes an absorbing agent tuned to a wavelength of the radiation.

13. The micro-fluid ejection device of claim 1, wherein the fluid includes an infrared absorbing agent.

14. The micro-fluid ejection device of claim 1 wherein the infrared absorbing agent comprises 2[2-[2chloro-3-[2-(3-ethyl-1,3-dihydro-1,1-dimethyl-2H-benzo[e]indol-2-ylidene)-ethylidene]-1cyclohexen-1-yl]-ethenyl]3-ethyl-1,1dimethyl-1H-benzo-[e]indolium tetrafluoroborate.

15. The micro-fluid ejection device of claim 1, wherein the coating comprises tantalum.

16. The micro-fluid ejection device of claim 1, wherein the radiation comprises a laser beam having a diameter no larger than 150% the size of the lens.

* * * * *